US009492042B2

(12) United States Patent
Zhu et al.

(10) Patent No.: US 9,492,042 B2
(45) Date of Patent: Nov. 15, 2016

(54) METHODS FOR AUTOMATICALLY CONFIGURING AN OPERATING SCHEDULE FOR AN ELECTRONIC TOILET DEVICE

(71) Applicant: Shanghai Kohler Electronics, LTD., Shanghai (CN)

(72) Inventors: Minghui Zhu, Shanghai (CN); Bo Hu, Shanghai (CN); Ni Li, Shanghai (CN); Dan Cao, Shanghai (CN); Yingfeng Wang, Shanghai (CN); Jiongjun Xue, Shanghai (CN); Weiran Xin, Shanghai (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 0 days.

(21) Appl. No.: 15/140,160

(22) Filed: Apr. 27, 2016

(65) Prior Publication Data

US 2016/0235264 A1 Aug. 18, 2016

Related U.S. Application Data

(62) Division of application No. 13/935,368, filed on Jul. 3, 2013, now Pat. No. 9,338,826.

(30) Foreign Application Priority Data

Jul. 5, 2012 (CN) ..... 2012 1 0232580

(51) Int. Cl.

| | |
|---|---|
| ***H05B 1/00*** | (2006.01) |
| ***A47K 13/30*** | (2006.01) |
| ***H05B 1/02*** | (2006.01) |
| ***H05B 3/28*** | (2006.01) |

(52) U.S. Cl.

CPC ..... *A47K 13/305* (2013.01); *H05B 1/0227* (2013.01); *H05B 1/0252* (2013.01); *H05B 3/28* (2013.01)

(58) Field of Classification Search

CPC ..... H05B 1/0251
USPC ..... 219/201; 304/605, 603; 340/605, 603, 340/521, 584, 540, 606; 4/420, 237
See application file for complete search history.

(56) References Cited

U.S. PATENT DOCUMENTS

2010/0289652 A1* 11/2010 Javey ..... H04Q 9/00 340/605

FOREIGN PATENT DOCUMENTS

| | | |
|---|---|---|
| CN | 101387125 | 3/2009 |
| CN | 101619589 | 1/2010 |

(Continued)

*Primary Examiner* — Phuong Nguyen
(74) *Attorney, Agent, or Firm* — Foley & Larder LLP

(57) ABSTRACT

A method for automatically configuring an electronic toilet device includes detecting usage of the electronic toilet device throughout a first time period. The first time period is divided into a plurality of discrete time units. The method further includes recording a usage state for each of the plurality of time units in the first time period based on the detecting and using the recorded usage states to configure an operating schedule for the electronic toilet device for a next time period. The method further includes operating the electronic toilet device throughout the next time period according to the operating schedule while detecting and recording a usage state for each of the plurality of time units in the next time period and periodically configuring an operating schedule for each subsequent time period using the recorded usage states associated with a preceding time period.

11 Claims, 2 Drawing Sheets

(56) References Cited

FOREIGN PATENT DOCUMENTS

| | | |
|---|---|---|
| CN | 201630988 | 11/2010 |
| CN | 102176852 | 9/2011 |
| JP | 2009-95366 | 5/2009 |
| TW | 201019877 | 6/2010 |

* cited by examiner

METHODS FOR AUTOMATICALLY CONFIGURING AN OPERATING SCHEDULE FOR AN ELECTRONIC TOILET DEVICE

CROSS-REFERENCE TO RELATED PATENT APPLICATIONS

The present application claims the benefit of and priority to Chinese Patent Application No. 201210232580.8, filed Jul. 5, 2012, under 35 U.S.C. §119. The entirety of Chinese Patent Application No. 201210232580.8 is incorporated by reference herein.

TECHNICAL FIELD

The present invention relates generally to control systems for electronic plumbing fixtures, and more particularly to systems and methods for controlling a heated toilet seat for use in a seat toilet assembly.

BACKGROUND

Traditionally, seat toilets have been designed to meet only our basic living needs. However, modern consumers often desire a seat toilet set that provides better user experiences. For instance, it may be desirable that a seat toilet set enables temperature conditioning (e.g., heating) such that the user, when sitting on the seat toilet set, will not feel cold.

To this end, various improvements have been made to the toilet seat. For instance, Chinese Patent Application CN102176852A discloses a warmed toilet seat device which is highly precise, comfortable, and economically efficient. Such a device is made possible by a simplified toilet seat structure and by performing output correction for the seat toilet heater. Additionally, Taiwan Patent TW201019877A1 discloses a heated seat toilet device which can advantageously reduce electric power consumed by the heating element without affecting user comfort.

Some heated toilet seats include control systems for reducing an amount of electric power consumed by the seat heating element. However, traditional control systems typically require the user to designate a predetermined time period for energy saving (e.g., during which the heating element will be inactive). If a user desires to use the toilet seat during an energy saving period, the user may encounter a cold and uncomfortable toilet seat. Requiring a user to predict a time during which the toilet seat will not be used can be burdensome and challenging (e.g., due to different lifestyles and usage habits among various users). Additionally, such traditional systems cannot dynamically self-adapt to usage habit changes and cannot account for different usage habits within any given time period.

SUMMARY

The present invention provides systems and methods for providing and controlling a seat toilet device (e.g., for a toilet assembly). The systems and methods described herein may be used to eliminate many of the problems associated with traditional seat toilet devices, as mentioned above.

One implementation of the present invention is a seat toilet device used for a seat toilet set. The seat toilet device includes a sensor and a study-memory module. The sensor is configured to sense a use condition of the seat toilet set and send the sensed result to the study-memory module. The study-memory module is configured to record and control a use condition of the seat toilet set within a predetermined time period which is divided into a plurality of time units. The study-memory module records the use condition of the seat toilet set during each time unit in the predetermined time period respectively based on the sensed result. The study-memory module controls a power consumption state of the set toilet set in the next time period based on the recorded use condition in the predetermined time period. The study-memory module also records the use condition of the set toilet set in the next time period to facilitate subsequent periodic control of the power consumption state of the set toilet set.

In some embodiments, the study-memory module initially controls the seat toilet set to maintain a heating state continuously during the first time period and starts recording the use condition of the seat toilet set during the first time period.

In some embodiments, the record made by the study-memory module for each time unit in the predetermined time period is defined as a unit memory segment. The study-memory module may be configured to control the power consumption state of the seat toilet set in the next time period based on each unit memory segment. In some embodiments, a unit memory segment during which the seat toilet set is instructed by the study-memory module to be under an in-use state is defined as a "busy time section" and a unit memory segment during which the seat toilet set is instructed to be under a not-in-use state is defined as an "idle time section."

In some embodiments, when a particular time unit in the predetermined time period is recorded as a busy time section, the study-memory module may cause the seat toilet set to enter the heating state during a time unit corresponding to the particular time unit in the next time period.

In some embodiments, the seat toilet device is configured to compare the number of idle time sections (e.g., time sections during which no use is detected) in the predetermined time period with a first threshold value. If the number of the idle time sections as recorded to present (e.g., continuously in the predetermined time period) is less than the first threshold value and the next unit memory segment is recorded as a busy time section, the idle time sections (as continuously recorded) may be defined as a "fragmentary idle time zone." In some embodiments, the seat toilet device is configured to remain in the heating state during a time zone in the next time period corresponding to the fragmentary idle time zone. However, if the number of the idle time sections as recorded to present (e.g., continuously in the predetermined time period) is equal to or larger than the first threshold value and the next unit memory segment is recorded as a busy time section, the idle time sections (as continuously recorded) may be defined as a "sustained idle time zone." In some embodiments, the seat toilet device is configured to enter a low power consumption state during a time zone in the next time period corresponding to the sustained idle time zone.

In some embodiments, the seat toilet device is configured to monitor and compare a number of continuous idle time sections with a second threshold value, greater than the first threshold value. If the number of continuous idle time sections is greater than the second threshold value, the study-memory module may control the seat toilet set to enter an energy-saving hibernation state, the hibernation state starting with the immediately next time unit.

In some embodiments, the time unit is one hour, the first threshold value is approximately 3 time sections, the second threshold value is approximately 168 time sections, and the predetermined time period is approximately 168 hours.

In some embodiments, the "in-use state" is defined as a state during which at least one of the following two conditions is true: (1) a user is sitting on the seat toilet set, and (2) a user is operating elements on the seat toilet set.

Advantageously, the seat toilet device of the present invention can automatically learn a usage pattern (e.g., usage habits, usage frequency, etc.) and adapt to the changes in the usage pattern throughout a time period having a relatively long duration (e.g., one week) which is subdivided into a plurality of shorter time sections. Further, according to the present invention, it is possible to determine more precisely whether the seat toilet set in a particular time section is under an "in-use state" or a "not-in-use state." The seat toilet set may be configured to enter the energy-saving state only when it is determined that the seat toilet set is not being used. The seat toilet set may be configured to maintain the seat ring in a heated state (e.g., at a temperature selected by a user) while the seat toilet set is being used. This configuration may advantageously facilitate a maximum possible energy savings for the seat toilet set without adversely affecting the user experience.

DETAILED DESCRIPTION

Referring generally to the FIGURES, systems and methods for controlling a heated toilet seat for use in a seat toilet assembly are shown, according to various exemplary embodiments. The toilet assembly may include a control device for controlling operation of the heated toilet seat. The control device of the present invention may include a study-memory module, which may be implemented in hardware form. The study-memory module may be configured to monitor and record a "use condition" of the toilet assembly (e.g., in use, not in use, etc.) during a first time period (e.g., a training period) based on a sensed state of the toilet assembly. The first time period may be divided into a plurality of time units t. The study-memory module may be configured to record a use condition of the seat toilet set for each time unit t within the first time period based on a sensed state of the toilet assembly during each of the plurality of time units t.

The study-memory module may be configured to control a power consumption state (e.g., a heating state, a low power consumption state, a hibernation state, etc.) of the heated toilet seat during a second time period (e.g., the next time period, a time period immediately subsequent to the first time period, etc.) based on the recorded use conditions for each of the plurality of time units t in the first time period. The study-memory module may also record the use condition of the toilet assembly during the second time period to facilitate subsequent periodic control of the power consumption state.

In some embodiments, use of the toilet assembly begins with an initialization step. In the initialization step, the control device may begin monitoring use conditions of the toilet assembly. During the first time period (e.g., immediately subsequent to initialization), the study-memory module may maintain the toilet seat in a continuous heating state.

In some embodiments, the record made by the study-memory module for each time unit t in the first time period is defined as a "unit memory segment." The study-memory module may be configured to control the power consumption state of the set toilet set in the second time period (e.g., subsequent to the first time period) based on each unit memory segment.

In some embodiments, if the record of a unit memory segment corresponding to a particular time unit $t_1$ indicates that the toilet assembly is in an "in-use state" during time unit $t_1$, the unit memory segment corresponding to time unit $t_1$ may be defined (e.g., categorized, labeled, marked, etc.) as a "busy time section." On the other hand, if the record of a unit memory segment corresponding to another time unit $t_2$ indicates that the toilet assembly is under a "not-in-use state" during time unit $t_2$, the unit memory segment corresponding to time unit $t_2$ may be defined as an "idle time section."

Figure 1:
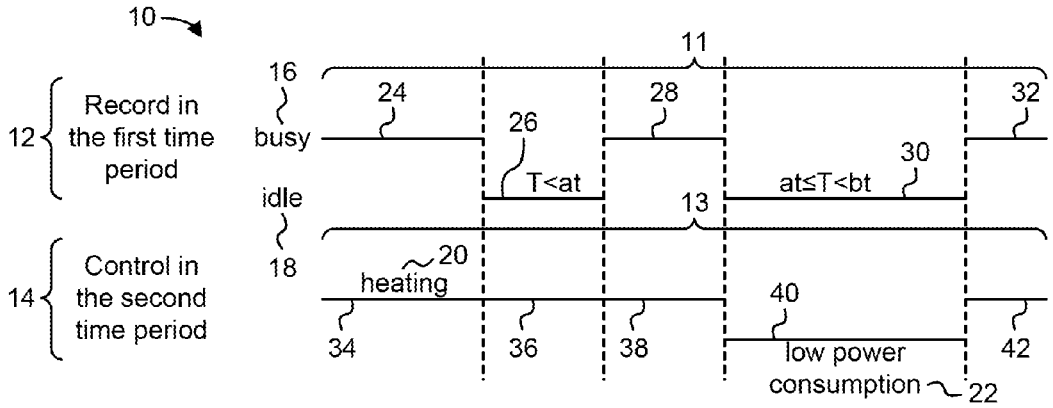
FIG. 1 is a timing diagram illustrating a relationship between a memory record for a first time period and a control state for a second time period for an automatic toilet assembly, according to an exemplary embodiment.

Referring now to FIG. 1, a timing diagram 10 illustrating a relationship between a memory record 12 for a first time period 11 and a control state 14 for a second time period 13 is shown, according to an exemplary embodiment. Second time period 13 may be the next time period immediately subsequent to first time period 11. Memory record 12 is shown to include a plurality of unit memory segments 24-32 (e.g., unit memory segments 24, 26, 28, 30, and 32). Unit memory segments 24-32 may be recorded as a busy time section 16 (e.g., for time units t during which the toilet assembly is in an in-use state) or an idle time section 18 (e.g., for time units t during which the toilet assembly is in a not-in-use state). For example, unit memory segments 24, 28, and 32 are shown as busy time sections 16 whereas unit memory segments 26 and 30 are shown is idle time sections 18. Unit memory segments 24-32 are shown separated by dotted lines indicating the time boundaries of the time units corresponding to unit memory segments 24-32.

Control state 14 is shown to include a plurality of control states 34-42 (e.g., control states 34, 36, 38, 40, and 42). Control states 34-42 may be set as a heating state 20 or a low power consumption state 22. In some embodiments, first time period 11 and second time period 13 may have similar or identical time units. For example, the first time unit of first time period 11 (e.g., corresponding to unit memory segment 24) may have a same or similar duration as the first time unit of second time period 13 (e.g., corresponding to control state 34).

For unit memory segments recorded as busy time sections in first time period 11 (e.g., unit memory segments 24, 28, and 32), the corresponding time units in second time period 13 (e.g., time units corresponding to control states 34, 38, and 42) may be set to a heating state 20. In some embodiments, so long as the next unit memory segment in first time period 11 remains to be a busy time section, the corresponding time unit in second time period 13 will remain in heating state 20.

Still referring to FIG. 1, memory record 12 is shown to include idle time sections 26 and 30. In some embodiments, if an idle time section follows one or more busy time sections, it is possible to either switch control state 14 into a low power consumption state 22 or maintain control state 14 in heating state 20. Whether control state 14 is switched to low power consumption state 22 or maintained in heating state 20 may depend on the duration of the idle time section or sections 18. In some embodiments, the duration may be the combined duration of one or more continuous idle time sections 18 between busy time sections 16.

In some embodiments, if the duration "T" of the one or more continuous idle time sections 18 between busy time sections 16 is less than a first threshold value "$thresh_1$," such idle time sections may be defined (e.g., marked, labeled, categorized, etc.) as a "fragmentary idle time zone." The first threshold value may be defined as the value of a first quantity "a" multiplied by the duration of a time element "t" (e.g., $thresh_1=a\cdot t$). For idle time sections 18 defined as a fragmentary idle time zone (e.g., the time section corresponding to unit memory segment 26, time sections having a duration $T<a\cdot t$, etc.), control state 14 may remain in heating state 20.

In some embodiments, if the duration T of the one or more continuous idle time sections 18 between busy time sections 16 is greater than or equal to the first threshold value $thresh_1$ but less than a second threshold value $thresh_2$ (e.g., $thresh_1 \leq T < thresh_2$), such idle time sections may be defined as a "sustained idle time zone." The second threshold value may be defined as the value of a second quantity "b" multiplied by the duration of the time element t (e.g., $thresh_2=b\cdot t$). For idle time sections 18 defined as a sustained idle time zone (e.g., the time section corresponding to unit memory segment 30, time sections having a duration $a\cdot t \leq T < b\cdot t$, etc.), control state 14 may be switched to low power consumption state 22.

Figure 2:
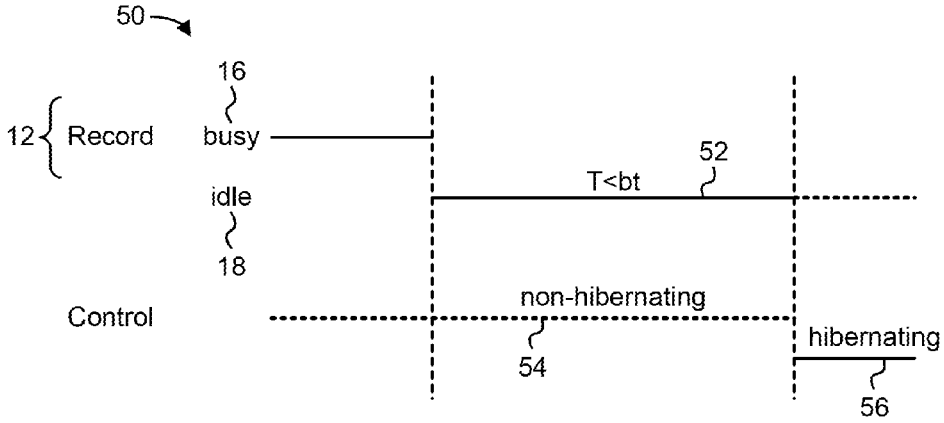
FIG. 2 is a record and control timing diagram illustrating the toilet assembly entering a hibernation state, according to an exemplary embodiment.

Referring now to FIG. 2, a record and control timing diagram 50 illustrating the toilet assembly entering a hibernation state 56 is shown, according to an exemplary embodiment. In some implementations, as memory record 12 is recorded during first time period 11, it may be determined that the duration T of one or more continuous idle sections 18 is equal to the value of the second threshold value $thresh_2$ (e.g., $T=b\cdot t$, corresponding to unit memory segment 52). Such idle time sections 18 may be defined as a "long idle time zone." For idle time sections 18 defined as a long idle time zone, the toilet assembly may be regarded as being in the not-in-use state for a long time. Upon the occurrence of a long idle time zone, the currently-active control state for the toilet assembly may be switched from a non-hibernation state 54 to an energy-saving hibernation state 56. In some embodiments, the control state may be switched into hibernation state 56 starting at the beginning of a time unit immediately subsequent to the long idle time zone (e.g., in first time period 11).

Notably, both the fragmentary idle time zone and the sustained idle time zone may be limited to a timeline occurring within a single time period (e.g., first time period 11). However, the long idle time zone can fall within one time period or can span over multiple time periods.

Figure 3:
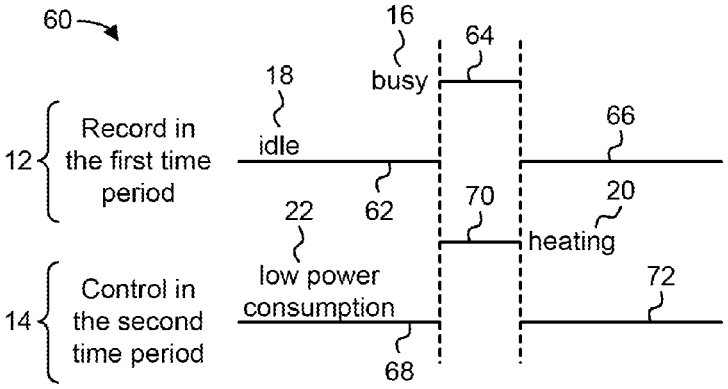
FIG. 3 is another timing diagram illustrating the relationship between the memory record and the control state of FIG. 1, according to an exemplary embodiment.

Referring now to FIG. 3, another timing diagram 60 illustrating the relationship between memory record 12 and control state 14 is shown, according to an exemplary embodiment. Timing diagram 60 is shown to include a busy unit memory segment 64 between two idle unit memory segments 62 and 66. If a busy time section 16 (e.g., a time section corresponding to unit memory segment 64) is observed in memory record 12 of first time period 11, a corresponding time section in second time period 13 may be set to heating state 20 regardless of the duration of the busy time section. For example, control state 14 may be switched from low power consumption state 68, to heating state 70, and then back to low power consumption state 72, regardless of the duration of the time unit corresponding to heating state 70 (e.g., bounded by dotted lines). Therefore, the concept of a "fragmentary busy time zone" may not exist in the present invention.

Figure 4:
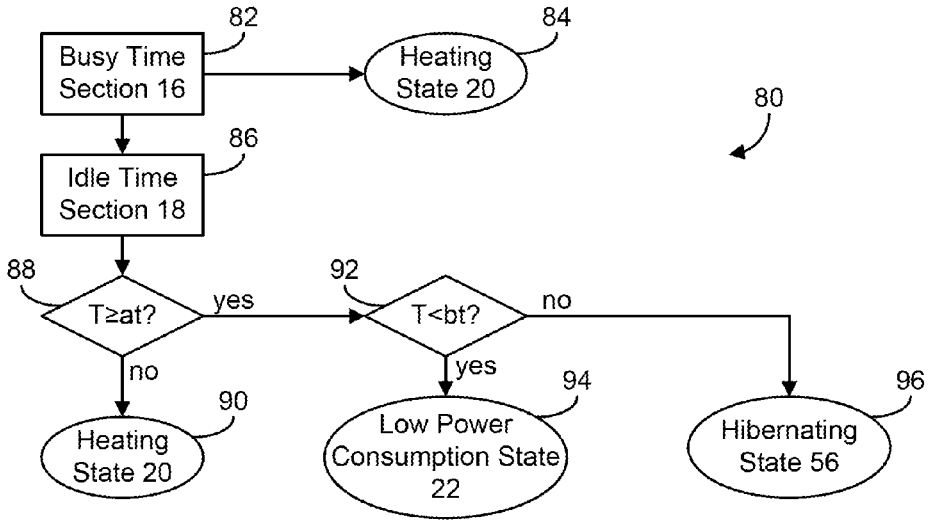
FIG. 4 is a flow diagram illustrating a process for controlling a heated toilet seat, according to an exemplary embodiment.

Referring now to FIG. 4, a flow diagram illustrating a process 80 for controlling a heated toilet seat is shown, according to an exemplary embodiment. In FIG. 4, a rectangular block represents an observation and/or recordation of one or more time sections in memory record 12 (e.g., busy time section 16, idle time section 18, a continuous combination of time sections, etc.) based on usage of the toilet assembly during first time period 11. An oval or circle represents setting a control state 14 for implementation during second time period 13 (e.g., heating state 20, low power consumption state 22, hibernation state 56, etc.). A diamond represents a control decision for translating memory record 12 into a particular control state 14.

Process 80 is shown to include observing/recording a busy time section 16 (step 82). Step 82 represents the observation and/or recordation of a unit memory segment defined as a busy time section 16. Step 82 may be performed during first time period 11, between first time period 11 and second time period 13, or any other time prior to second time period 13.

Process 80 is shown to further include setting heating control state 20 (step 84). Step 84 may be performed in response to an observation and/or recordation of a busy time section 16 (e.g., in step 82). When a unit memory segment is observed and/or recorded as a busy time section 16, a corresponding time section in second time period 13 may be set to heating state 20.

Process 80 is shown to further include observing/recording an idle time section 18 (step 86). Step 86 represents the observation and/or recordation of a unit memory segment defined as an idle time section 18. Idle time section 18 may occur subsequent to busy time section 16 in first time period 11.

Process 80 is shown to further include determining whether the duration T of idle time section 18 is greater than or equal to than the product of first quantity a multiplied by the duration of time element t (e.g., $T \geq a\cdot t$) (step 88). Step 88 may be performed in response to an observation and/or recordation of an idle time section 18 (e.g., in step 86). The duration T of idle time section 18 may be the duration of a single time section corresponding to a single unit memory segment, or the combined duration of two or more continuous idle time sections 18.

Process 80 is shown to further include setting heating control state 20 (step 90). Step 90 may be performed in response to a determination (e.g., in step 88) that the duration of the one or more continuous idle time sections 18 is not greater than or equal to the product of first quantity a multiplied by the duration of time element t (e.g., $T<a\cdot t$). Step 90 may indicate that the one or more continuous idle time sections 18 qualify as a fragmentary idle time zone.

Process 80 is shown to further include determining whether the duration T of the one or more idle time sections 18 is less than the product of second quantity b multiplied by the duration of time element t (e.g., $T<b\cdot t$) (step 92). Step 92 may be performed in response to a determination (e.g., in step 88) that the duration of the one or more idle time sections 18 is greater than or equal to the product of first quantity a multiplied by the duration of time element t (e.g., $T \geq a \cdot t$). A positive determination in step 92 (e.g., $T < b \cdot t$) may reveal that the one or more continuous idle time sections 18 are sufficiently long in duration to avoid qualifying as a fragmentary time zone, but not long enough to qualify as a long idle time zone.

Process 80 is shown to further include setting a low power consumption state 22 (step 94). Step 94 may be performed in response to a determination (e.g., in step 92) that the duration T of the one or more idle time sections 18 is less than the product of second quantity b multiplied by the duration of time element t (e.g., $T < b \cdot t$). In some embodiments, step 92 is only performed in response to a positive determination in step 88 (e.g., $T \geq a \cdot t$). Therefore, a positive determination in step 92 may provide sufficient information to determine that $a \cdot t \leq T < b \cdot t$. Step 94 may be performed when the duration of the one or more continuous idle time sections 18 is long enough to warrant entering low power consumption state in second time period 13, but not long enough to warrant activation of hibernating state 56. In other words, step 94 may be performed when a sustained idle time zone is observed.

Process 80 is shown to further include setting a hibernating state 56 (step 96). Step 96 may be performed in response to a determination (e.g., in step 92) that the duration T of the one or more idle time sections 18 is greater than or equal to the product of second quantity b multiplied by the duration of time element t (e.g., $T \geq b \cdot t$). Step 96 may be performed when the duration T indicates the occurrence of a long idle time zone. In some embodiments, step 96 is performed immediately upon beginning the next time section (e.g., in first time period 11) without waiting until the corresponding time section in second time period 13. Upon performance of step 96, the toilet assembly is switched into energy-saving hibernating state 56, thereby maximizing energy conservation during periods of sustained non-use.

Notably, process 80 is shown to include two determinations for comparing duration T with $a \cdot t$ (e.g., in step 88) and subsequently with $b \cdot t$ (e.g., in step 92). However, it is appreciated for those skilled in the art that it is also possible to perform only the one determination for comparing T with $a \cdot t$. If $T \geq a \cdot t$ is true, the toilet assembly may enter low power consumption state 22 directly. If $T \geq a \cdot t$ is false, the toilet assembly may be controlled to remain in heating state 20.

In some embodiments, time unit t is approximately one hour. The first threshold value $thresh_1$ (e.g., the minimum sustained idle time zone) may be approximately 3 hours and the second threshold value (e.g., the minimum long idle time zone) may be approximately 168 hours. In some embodiments, the total duration of first time period 11 (e.g., one time period for recording) may be approximately 168 hours. In the initial 168 hours, the toilet assembly can be initialized (e.g., trained, programmed, etc.). During the initialization period, actual usage of the toilet assembly can be recorded. In some embodiments, the toilet assembly is maintained in heating state 20 throughout the initialization period.

Second time period 13 may span from the 169th hour to the 336th hour. During second time period 13, actual usage of the toilet assembly may continue to be monitored and/or recorded and operation of the toilet assembly may be controlled based on the memory record of the previous 168 hours (e.g., memory record 12). For instance, if the 1st hour and the 2nd hour are recorded to be busy time sections, the toilet assembly may be controlled to enter heating state 20 from the 169th hour to the 170th hour (e.g., the 1st and 2nd hours of second time period 13).

In some embodiments, if the 3rd hour and the 4th hour are continuous idle time sections 18 and the 5th hour is a busy time section 16, the duration from the 3rd hour to the 4th hour (e.g., two hours) is less than 3 hours and consequently regarded as a fragmentary idle time zone. If the 3rd hour to the 4th hour are categorized as fragmentary idle time zones, the toilet assembly may remain in heating state 20 from the 171st hour to the 172nd hour (e.g., the 3rd-4th hours of second time period 13).

In some embodiments, if the sections from the 10th hour to the 15th hour are continuously recorded as idle time sections, the time zone therefrom lasts for 5 hours and is regarded as a sustained idle time zone. Upon detection of a sustained idle time zone, the toilet assembly may be set to switch into low power consumption state 22 from the 178th hour to the 183rd hour (e.g., the 10th-15th hours of second time period 13).

At any time when usage of the toilet assembly is being recorded, provided that any presented continuous 168 hours are recorded as idle time sections, such continuous 168 hours can be defined as a long idle time zone. Upon detection of a long idle time zone, the toilet assembly may be switched into hibernating state 56 accordingly. Hibernation state 56 may be activated starting with the hour immediately subsequent to the hour during which the long idle time zone is detected.

As can be seen from the above process, the seat toilet control device of the present invention effectively prevents the toilet assembly from switching into the low power consumption state frequently (e.g., due to the detection of fragmentary idle time zones and maintenance of the toilet assembly in the heating state during fragmentary idle time zones). Advantageously, a user can use the seat toilet set normally without feeling uncomfortable due to contacting a low temperature seat ring.

It should be noted that the mentioned "in use state" of the seat toilet set can include two conditions: (1) the user is sitting on the toilet seat, and (2) the user is operating elements of the toilet assembly (e.g., an onboard control keyboard of the toilet assembly). The "in-use state" and "not in use state" of the toilet assembly can be sensed by a sensor in the seat toilet device. The sensor may send the sensed use condition of the toilet assembly (e.g., in use, not in use, etc.) to the study-memory module. The study-memory module may be configured to define unit memory segments (e.g., during first time period 11) and set control states (e.g., for second time period 13) based on the received use conditions.

Figure 5:
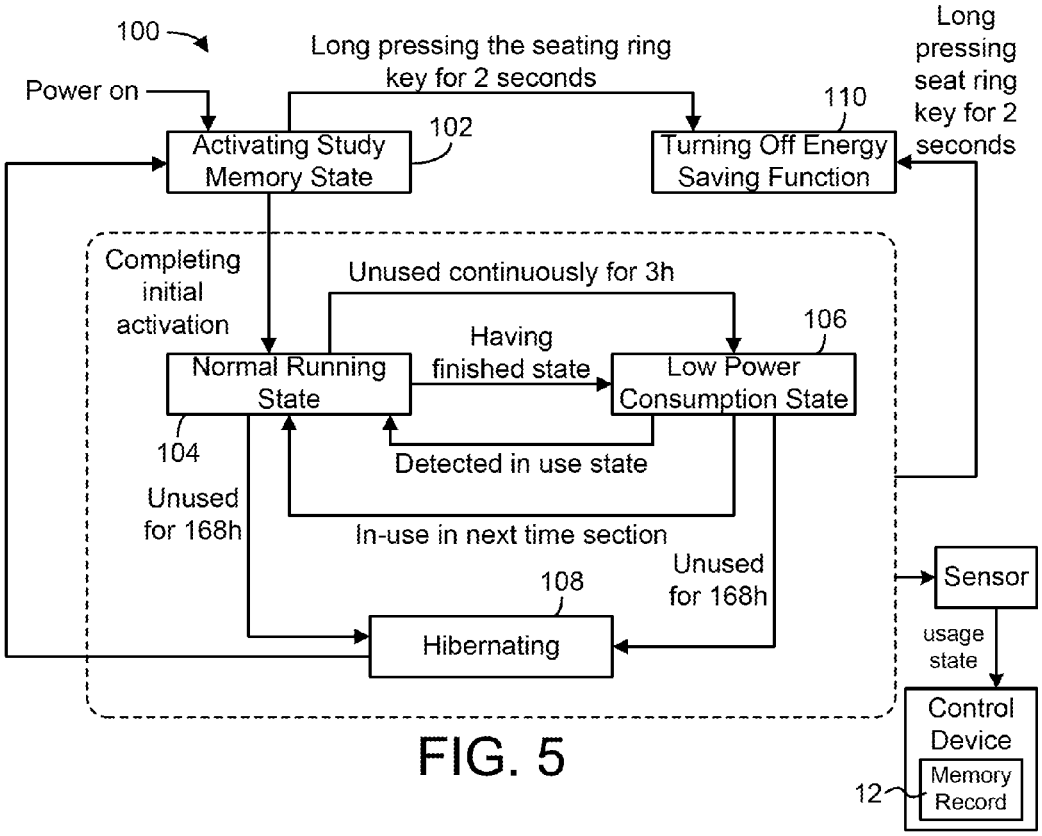
FIG. 5 is an energy-saving state transfer diagram for the toilet assembly, illustrating the transition between various control states, according to an exemplary embodiment, according to an exemplary embodiment.

Referring now to FIG. 5, an energy-saving state transfer diagram 100 for the toilet assembly is shown, according to an exemplary embodiment. Upon initially powering on, the toilet assembly may activate a study memory state (state 102). When initial activation is completed, the toilet assembly may enter a normal running state (state 104). In some embodiments, state 104 may be equivalent to heating state 20. For example, when in normal running state 104, heat may be applied to the toilet seat. Transferring from state 102 to state 104 may cause the toilet assembly to activate an energy saving function.

When operating in normal running state 104, a study-memory module may monitor usage of the toilet assembly (e.g., from a current or previous time period). If the study-memory module detects that the toilet assembly is not used for a first threshold time period (e.g., three hours) or if the study-memory module detects that a user has just finished using the toilet assembly, study-memory module may switch the toilet assembly into a low power consumption state (state 106). If it is detected that the toilet assembly is not used for a second threshold time period (e.g., 168 hours, one week, etc.), the toilet assembly may be switched into an energy conserving hibernation state (state 108).

Low power consumption state 106 may be similar or the same as low power consumption state 22. While operating in the low power consumption state 106, the study memory module may continue to monitor usage of the toilet assembly. If it is detected that the toilet assembly is used when in low power consumption state 106, the toilet assembly may be switched into normal running state 104. If it is detected that the toilet assembly is not used for a second threshold time period (e.g., 168 hours, one week, etc.), the toilet assembly may be switched into an energy conserving hibernation state 108.

Hibernation state 108 may be similar or the same as hibernating state 56. Upon exiting hibernation state 108, the study-memory module can re-activate study-memory state 102 to detect a subsequent use condition of the toilet assembly. When the toilet assembly is implementing the energy saving function (e.g., in states 104, 106, and 108), a user can press a seat ring key on the seat ring for a certain time (e.g., 2 seconds) to deactivate the energy saving function and enter a non-conservation state (state 110).

As can be seen from the above description, the seat toilet device of the present invention can automatically study usage patterns and adapt to changes in usage habits over time. A relatively long training and usage period (e.g., one week) may be split into different time sections. Further, according to the present invention, it is possible to determine more precisely whether the toilet assembly in a certain time section is under an in-use state or a not-in-use state. The energy saving state may only be activated when it is determined that the toilet assembly is not being used. Heating may be applied to the seat ring during use to maintain the toilet seat at a desired temperature (e.g., as may be configured by the user). Advantageously, the systems and methods of the present disclosure may maximize energy conservation without adversely affecting the user experience.

What is claimed is:

1. A method for automatically configuring an electronic toilet device, the method comprising:

detecting usage of the electronic toilet device by a user throughout a first time period, wherein the first time period is divided into a plurality of discrete time units;

recording a usage state for each of the plurality of time units in the first time period based on the detecting, wherein a busy usage state is recorded for a time unit in a memory record for the first time period if usage is detected during the time unit and wherein an idle usage state is recorded for a time unit in the memory record for the first time period if usage is not detected during the time unit, wherein the time units in the first time period for which a busy usage state is recorded are busy time units and wherein the time units in the first time period for which an idle usage state is recorded are idle time units;

using the recorded usage states to configure an operating schedule for the electronic toilet device for a next time period, wherein the next time period is divided into a plurality of discrete time units, wherein configuring the operating schedule comprises defining a heating state for time units in the next time period which correspond to busy time units in the first time period;

operating the electronic toilet device throughout the next time period according to the operating schedule while detecting and recording a usage state for each of the plurality of time units in the next time period; and periodically configuring an operating schedule for each subsequent time period using the recorded usage states associated with a preceding time period.

2. The method of claim 1, wherein the operating schedule is a power conservation schedule for the electronic toilet device;

wherein configuring the operating schedule includes configuring the electronic toilet device to enter at least one of a heating state, a low power consumption state, and a hibernating state.

3. The method of claim 2, wherein the heating state and the low power consumption state are operating states associated with a heating element for a heated seat of the electronic toilet device.

4. The method of claim 1, wherein configuring the operating schedule for the next time period includes:

identifying, for each of the time units in the next time period, a corresponding time unit in the first time period; and defining a control state for each of the time units in the next time period, wherein the control state for a particular time unit in the next time period is based on the recorded usage state for the corresponding time unit in the first time period.

5. The method of Claim 1, further comprising defining a low power consumption state for time units in the next time period which correspond to idle time units in the first time period.

6. The method of Claim 1, further comprising: determining, for each of the time units in the next time period, whether the corresponding time unit in the first time period is a busy time unit or an idle time unit; comparing a duration of each corresponding idle time unit with a first threshold value; and defining a low power consumption state for time units in the next time period which correspond to idle time units in the first time period having a duration greater than the first threshold value.

7. The method of claim 6, further comprising:

comparing the duration of each corresponding idle time unit with a second threshold value greater than the first threshold value; and defining the low power consumption state for time units in the next time period which correspond to idle time units in the first time period having a duration between the first threshold value and the second threshold value.

8. The method of claim 6, further comprising:

determining, for each of the time units in the next time period which correspond to an idle time unit in the first time period, whether the corresponding idle time unit is part of a series of consecutive idle time units;

comparing a combined duration of the series of consecutive idle time units with the first threshold value; and defining the low power consumption state for time units in the next time period which correspond to idle time units in the first time period which are part of a series of consecutive idle time units having a combined duration greater than the first threshold value.

9. The method of claim 8, further comprising:

comparing the combined duration of the series of consecutive idle time units with a second threshold value greater than the first threshold value; and defining the low power consumption state for time units in the next time period which correspond to idle time units in the first time period which are part of a series of consecutive idle time units having a combined duration between the first threshold value and the second threshold value.

10. The method of claim 1, further comprising:

monitoring an elapsed time since usage of the electronic toilet device was most recently detected;

comparing the elapsed time with a threshold value; and controlling the electronic toilet device to enter a hibernation state if a result of the comparison reveals that the elapsed time is greater than or equal to the threshold value.

11. The method of claim 1, wherein the plurality of discrete time units have a non-uniform duration.

* * * * *